US012434890B2

(12) United States Patent
Nusbaum

(10) Patent No.: US 12,434,890 B2
(45) Date of Patent: Oct. 7, 2025

(54) CONTAINER CLOSURE WITH TAMPER-EVIDENT RING, AND METHOD FOR ASSEMBLING A CONTAINER CLOSURE OF THIS KIND

(71) Applicant: BERICAP HOLDING GMBH, Budenheim (DE)

(72) Inventor: Philippe Nusbaum, Orthez (FR)

(73) Assignee: BERICAP HOLDING GMBH, Budenheim (DE)

( * ) Notice: Subject to any disclaimer, the term of this patent is extended or adjusted under 35 U.S.C. 154(b) by 71 days.

(21) Appl. No.: 18/549,392

(22) PCT Filed: Mar. 7, 2022

(86) PCT No.: PCT/EP2022/055744
§ 371 (c)(1),
(2) Date: Sep. 7, 2023

(87) PCT Pub. No.: WO2022/189351
PCT Pub. Date: Sep. 15, 2022

(65) Prior Publication Data

US 2024/0150093 A1 May 9, 2024

(30) Foreign Application Priority Data

Mar. 10, 2021 (DE) ..... 102021105870.8
May 28, 2021 (DE) ..... 102021113872.8

(51) Int. Cl.
*B65D 47/08* (2006.01)
*B65D 55/08* (2006.01)

(52) U.S. Cl.
CPC ..... *B65D 55/0827* (2013.01); *B65D 47/0804* (2013.01); *B65D 2401/05* (2020.05); *B65D 2401/45* (2020.05); *B65D 2555/025* (2013.01)

(58) Field of Classification Search
CPC ..... B65D 2401/15; B65D 2401/30; B65D 2401/05; B65D 2401/45; B65D 47/0804;
(Continued)

(56) References Cited

U.S. PATENT DOCUMENTS 3,240,405 A 3/1966 Abbott
5,088,612 A 2/1992 Storar et al.
(Continued)

FOREIGN PATENT DOCUMENTS

DE 69605288 T2 7/2000
EP 0590325 B1 4/1998
(Continued)

OTHER PUBLICATIONS

International Search Report and Written Opinion mailed Jul. 7, 2022, in connection with International Patent Application No. PCT/EP2022/055744, 11 pgs. (including translation).
(Continued)

*Primary Examiner* — King M Chu
(74) *Attorney, Agent, or Firm* — Chiesa Shahinian & Giantomasi PC

(57) ABSTRACT

The invention relates to a container closure comprising a base portion which extends about a reference axis of the container closure, a cap portion which in a closed positioned covers a drinking hole in the container closure and in an open position leaves said drinking hole in the container closure uncovered, and a tamper-evident ring which is separate from the cap portion and the base portion and is interlockingly connected to the cap portion and connected to the base portion in a hooked manner. The tamper-evident ring has an annular bead that is not radially covered by the base portion and extends in an annular groove of an outer wall of the cap portion, which wall faces radially outward.

19 Claims, 10 Drawing Sheets

(58) Field of Classification Search
CPC ..... B65D 47/0838; B65D 47/0809; B65D 47/0861; B65D 47/243; B65D 55/16; B65D 55/024; B65D 55/0827; B65D 2251/105; B65D 41/3428; B65D 41/3447
USPC ..... 220/288, 838; 215/235, 237, 344
See application file for complete search history.

(56) References Cited

U.S. PATENT DOCUMENTS

| | | | | |
|---|---|---|---|---|
| 5,540,343 | A | 7/1996 | Schumacher | |
| 5,642,824 | A | 7/1997 | Hess, III et al. | |
| 2005/0133475 | A1* | 6/2005 | Goto | B65D 50/046 215/237 |
| 2006/0043052 | A1* | 3/2006 | Lin | B65D 47/0838 215/253 |
| 2009/0120936 | A1* | 5/2009 | Zauser | B65D 41/3447 215/217 |
| 2015/0344196 | A1* | 12/2015 | Groubert | B65D 55/024 220/315 |

FOREIGN PATENT DOCUMENTS

| | | | | |
|---|---|---|---|---|
| EP | 1892194 | A1 | 2/2008 | |
| EP | 2250102 | B1 | 9/2014 | |
| EP | 3659937 | A1 | 6/2020 | |
| GB | 2430667 | A | 4/2007 | |
| WO | 2008024775 | A1 | 2/2008 | |
| WO | WO-2015049066 | A1 * | 4/2015 | B65D 47/0804 |

OTHER PUBLICATIONS

International Search Report and Written Opinion mailed Jul. 7, 2022, in connection with International Patent Application No. PCT/EP2022/055746, 13 pgs. (including translation).

* cited by examiner

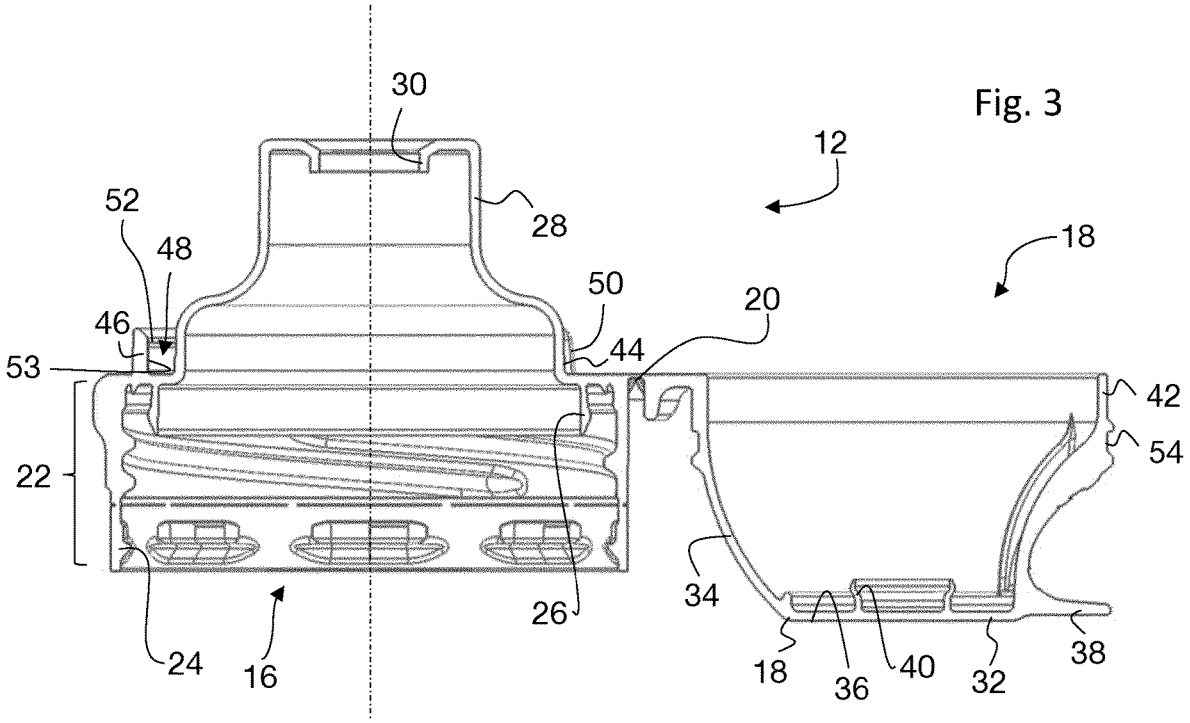
Fig. 3
Fig. 4
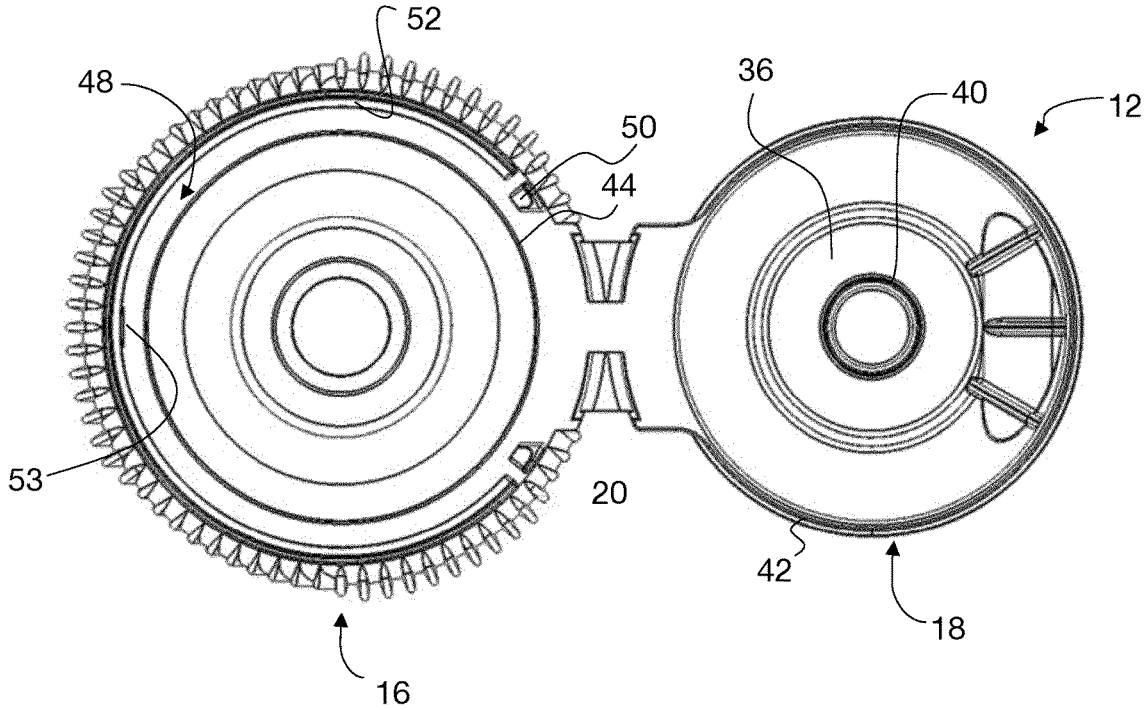

Fig. 5
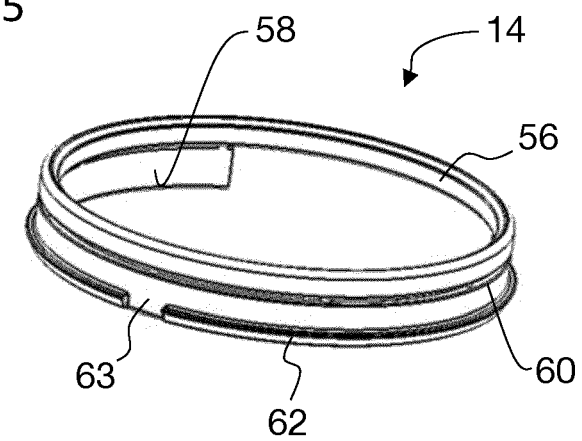
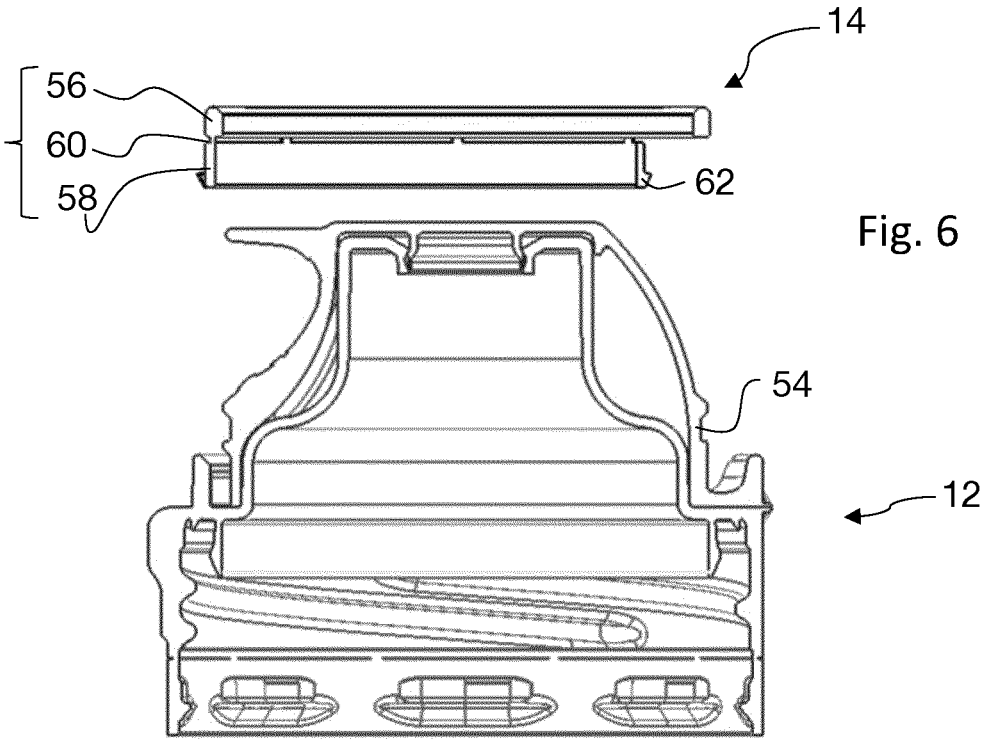
Fig. 6

Fig. 7
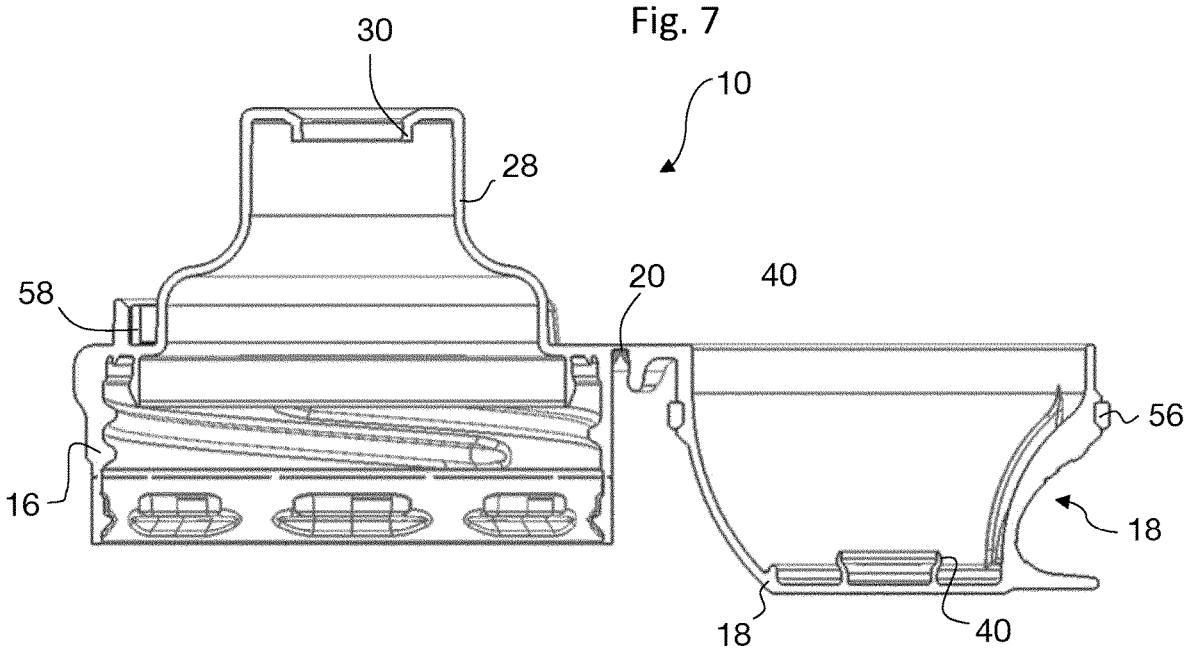
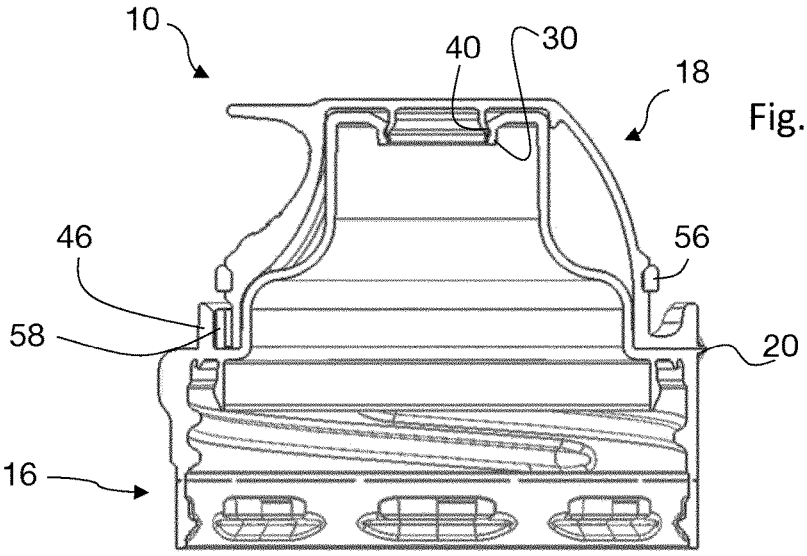
Fig. 8

CONTAINER CLOSURE WITH TAMPER-EVIDENT RING, AND METHOD FOR ASSEMBLING A CONTAINER CLOSURE OF THIS KIND

CROSS-REFERENCE TO RELATED APPLICATION(S)

This application is a National Stage under 35 U.S.C. 371 of International Patent Application No. PCT/EP2022/055744, filed Mar. 7, 2022, which claims the benefit of priority under 35 U.S.C. 119 to: (i) German Patent Application No. 102021113872.8, filed May 28, 2021; and (ii) German Patent Application No. 102021105870.8, filed Mar. 10, 2021; the disclosures of all of which are incorporated herein by reference in their entirety.

FIELD OF APPLICATION OF THE INVENTION

The invention relates to a container closure having a base portion which extends around a reference axis of the container closure, a cap portion which in a closed position covers a mouth/opening of the base portion and in an open position leaves the mouth of the base portion open, and a tamper-evident ring separate from the cap portion and base portion which is designed to provide the consumer with visible information as to whether the container closure has already been opened. It also relates to a method for assembling such a container closure.

PRIOR ART TO DATE

From the document WO2015/049066 A1 a container closure of the type mentioned at the beginning is known, in which the tamper-evident ring is covered by the cap portion and base portion in the closed position and is only visible through a transparent wall of the cap portion. The base portion, cap portion and hinge together form an injection molded part that is formed in the open position. This piece is moved to the closed position before the tamper-evident ring is inserted through the opening in the base portion. After the tamper-evident ring has found its position, a spout is inserted into the opening and assembled with the base portion.

A disadvantage of such a closure is the necessary use of a transparent material, such as transparent polypropylene, for the injection molded piece that forms the base portion and the cap portion. Other materials such as opaque polypropylene or high-density polyethylene (HDPE) are excluded. A disadvantage of polypropylene closures is the dust generated by friction of the manufactured closures on the belt feeders of the filling lines.

It is also not possible to choose two different materials or two different colors for the base portion and the cap portion. With a clear cap portion, the contents of the container are exposed to light through the spout and the bottom of the cap portion, which is undesirable in certain cases.

Further, after production, quality control is complicated by the fact that the tamper-evident ring is no longer accessible after mounting.

The container closure is necessarily produced from at least three separate pieces, especially since the tamper-evident ring must be mounted through the opening of the base portion. It is thus not possible to provide a range of container closures that provide the same visible information to the consumer about the unadulterated state of the container contents, and of which at least some models are formed from only two separate pieces.

PRESENTATION OF THE INVENTION

The object of the invention is to provide a container closure of the prior art which remedies at least one of the above-mentioned disadvantages of the prior art.

In a container closure having a base portion which extends about a reference axis of the container closure, a cap portion which in a closed position covers a drinking opening of the container closure and in an open position leaves the drinking opening of the container closure open, and a tamper-evident ring which is separate from the cap portion and base portion, is positively connected to the cap portion and is hooked to the base portion, and has a breaking zone which breaks when the cap portion is opened and causes a non-reversible and visible change in the container closure, the object is solved in that the tamper-evident ring for form-fit connection to the cap portion has an annular bead which is not radially covered by the base portion and extends in an annular groove of an outer wall of the cap portion which faces radially outwardly.

By having the annular bead of the tamper-evident ring applied to an uncovered outer wall of the cap portion, the cap portion can be produced from an opaque material, if necessary. Numerous materials and colors can be used. The colors of the cap portion and the tamper-evident ring can be selected to create a desired color contrast, e.g. complementary colors.

The tamper-evident ring can be placed on the cap portion in the closed position by elastic deformation until the annular bead enters the annular groove and the tamper-evident ring is hooked to the base portion.

In accordance with a preferred embodiment, the tamper-evident ring has an indicator portion that engages behind a shoulder of the base portion for hook-like connection to the base portion, wherein the breaking zone is between the bead and the indicator portion. Preferably, the base portion has a peripheral wall surrounding the indicator portion and a cavity of the base portion. Upon opening of the cap portion and rupture of the breaking zone, the indicator portion may fall into a lower area of the cavity due to the force of gravity. Where appropriate, the wall may have a radially outwardly facing window configured so that the indicator portion is not visible through the window before the breaking zone is broken and is only visible through the window after the breaking zone is broken in the lower part of the cavity.

In accordance with a preferred embodiment, the indicator portion projects radially outward and the shoulder projects radially inward. Thus, there is no overlap between the outward-facing indicator portion and the inward-facing bead, which facilitates axial demolding of the tamper-evident ring. An additional advantage of this embodiment arises when the cap portion is hinged to the base portion, in that at the beginning of the rotational movement of the cap portion from the closed position, the hook-like connection between the indicator portion and the shoulder is not weakened.

In accordance with a preferred embodiment of the invention, the base portion is connected to the cap portion by a hinge.

The cap portion may be integrally designed with the hinge and base portion to form a two-piece container closure.

Alternatively, the base portion may have a base portion and an anchor ring engaging an annular groove of the base portion, wherein the anchor ring is integrally designed with the hinge and the cap portion. The container closure then consists of three pieces, which may be produced from different materials. The breaking zone is preferably located axially between the annular bead and the anchor ring. The indicator portion is preferably located axially between the breaking zone and the armature ring. The cavity is preferably located axially between the indicator portion and the armature ring.

The hinge and the hook-like connection between the tamper-evident ring and the base portion are preferably located on the same side of a transverse plane extending through the annular bead. Alternatively, it is also envisaged that the hinge can be designed integrally with the tamper-evident ring.

In accordance with a preferred embodiment, the base portion has a connection point, particularly a thread, for connection to a container neck. However, other means of attachment are conceivable, such as a circumferential locating bead or a series of resilient latching hooks distributed around the circumference of the base portion and engaging behind a circumferential retaining bead of the container neck when mounted on the container neck.

The base portion may have a sealing bead, preferably directed radially outward, to provide a tight connection to the container neck.

The base portion may have a spout area that forms the drinking opening of the base portion.

Alternatively, the container closure may have a pouring portion separate from the base portion, forming a pouring region and the drinking opening of the container closure, wherein the pouring portion is covered by the cap portion in the closed position.

The breaking zone extends to an angle preferably greater than 90°, preferably greater than 180° about the reference axis of the container closure, and may optionally have frangible ridges, a breakaway line, or a breakaway band.

The cap portion has a bottom that closes the opening of the base portion. Preferably, the outer wall of the cap portion tapers from the groove to the base.

The invention also relates to a method for assembling a container closure according to the invention, wherein the tamper-evident ring is placed on the cap portion in the closed position by elastic deformation until the annular bead enters the annular groove and the tamper-evident ring is hooked to the base portion.

BRIEF DESCRIPTION OF THE DRAWINGS

Embodiments of the present invention will be described with reference to the accompanying drawings. Showing:

FIG. 3: a sectional view of an injection molded part of the container closure in accordance with the first embodiment, in an open position immediately after being ejected from the injection mold;

FIG. 4: a top view of the injection molded part of FIG. 3;

FIG. 5: a perspective view of a guarantor ring of the container closure according to the first embodiment example;

FIG. 6: a sectional view of the molded part of FIG. 4 after it has been placed in the closed position and of the guarantee ring of FIG. 5 before it is placed on the closed molded part;

FIG. 7: a sectional view of the container closure according to the first embodiment, in the open position after the first opening;

FIG. 8: a sectional view of the container closure in accordance with the first embodiment, in the closed position after the first opening;

In all drawings, individual reference numerals denote identical or similar elements.

DETAILED DESCRIPTION OF EMBODIMENT EXAMPLES

Figure 1:
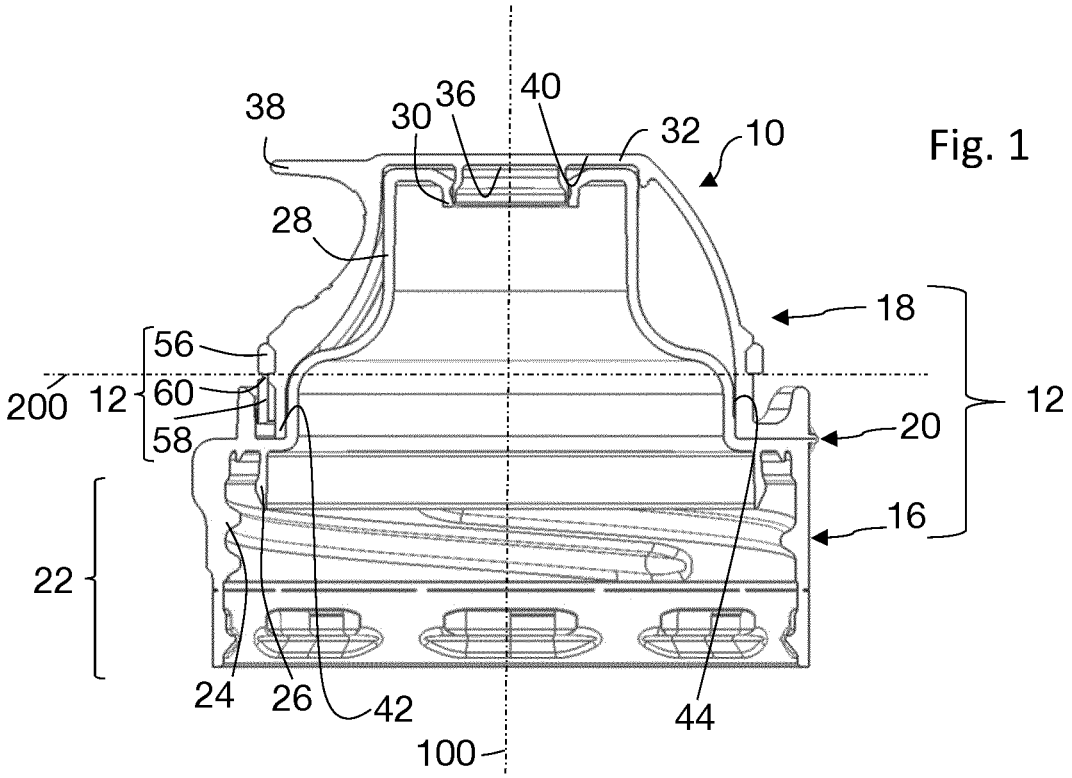
FIG. 1: a sectional view of a container closure in accordance with a first embodiment of the invention in a closed position in front of the first opening.

Referring to FIGS. 1 to 8, a first preferred embodiment of a container closure of the present invention is indicated by the reference numerals 10. The closure 10 is determined to be mounted on the neck of a container.

In this embodiment, the container closure 10 is composed of two separate injection molded parts, namely a closure piece 12 and a tamper-evident ring 14. The closure piece 12 may be produced from a plastic or other material that is compatible with the container contents. A polymer is preferred here, particularly a thermoplastic such as polyethylene or polypropylene. In particular, opaque materials such as opaque polypropylene or high-density polyethylene (HDPE) can be used here. The tamper-evident ring 14 can be made of a plastic, particularly an opaque plastic, preferably with a color that provides a desirable color contrast with the closure piece.

The closure piece 12, shown individually in FIGS. 3 and 4, comprises a base portion 16, a cap portion 18, and a hinge 20 connecting the base portion 16 to the cap portion 18. The hinge 20 is shown here as a snap hinge and allows the cap portion 18 to pivot about a pivot axis that extends perpendicular to the section plane of FIG. 1. Other types of hinges are also applicable. The base portion 16, the cap portion 18, and the hinge 20 are cast together in one piece in the open position, as shown in FIGS. 3 and 4.

The base portion 16 has an attachment area 22 enclosing a reference axis 100 of the container closure 10, and means for fastening to the container neck, in this embodiment a thread 24. Also present in the attachment area is a sealing skirt 26 designed to engage the interior of the container neck when the container closure 10 is placed on the container neck. The sealing skirt 26 may have a circumferential bead or curvature. In this embodiment, the base portion 16 further has a spout area 28 projecting axially in the direction opposite the attachment area, surrounding a drinking opening 30.

The cap portion 18 comprises a bottom 32, an outer wall 34, which surrounds an inner wall surface 36 of the bottom 32, and a gripping protrusion 38, which extends radially outward from the outer wall 34.

The bottom 32 can be flat or curved. From the inner wall surface 36 of the bottom 32 extends an annular sealing skirt 40, which is enclosed by the outer wall 34 with radial distance. This sealing skirt 40 is designed to engage the inside of the drinking opening 30 of the pouring area 28 when the cap portion 18 is in the closed position. The sealing skirt 40 may have a circumferential bead or curvature.

The outer wall 34 has a lower cylindrical or slightly conical edge area 42 which, in the closed position of the closure piece 12, radially abuts a cylindrical or slightly conical seating surface 44 directed radially outwardly in a connecting area between the spout area 28 and the attachment area 22 of the base portion 14. Thus, the cap portion 18 in the closed position encloses the pouring area 28. The edge area 42 and sealing skirt 40 allow liquid and gas tight sealing of the space enclosed by the cap portion 18 and base portion 14, if necessary. This is advantageous for the use of the closure for aseptic filling.

The seating surface 44 is partially enclosed by a curved peripheral wall 46 which projects axially from the attachment area 22 in the direction opposite to the thread 24 and extends through an angle preferably greater than 90°, in the example greater than 180° about the reference axis 100 of the container closure 10. The seating surface 44 and the peripheral wall 46 are radially spaced apart and define an arcuate cavity 48 into which the lower edge area 42 of the outer wall 34 of the cap portion 18 enters in the closed position. The arc-shaped cavity 48 is bounded circumferentially by two stops 50, as shown in FIG. 4. The peripheral wall 46 has a radially inwardly projecting shoulder 52 which has a median interruption 53 so that it is visible in the sectional plane of FIG. 2 but not in the sectional plane of FIG. 1.

The outer wall 34 of the cap portion 18 has a radially outwardly directed annular groove 54, which is preferably located in a central area of the cap portion 18 axially between the bottom 32 and the lower edge area 42 and which, in the closed position, is not covered by the curved peripheral wall 46 of the base portion 16.

The tamper-evident ring 14 shown in FIGS. 5 and 6 has an annular closed bead 56 projecting inward in the radial direction, an arc-shaped indicator portion 58, and a breaking zone 60 located between the bead 56 and the indicator portion 58. The breaking zone 60 may preferably have frangible ridges or a breakaway line, or possibly a breakaway band. The indicator portion 58 has a radially outwardly projecting hook portion 62 with a central interruption 63.

Figure 2:
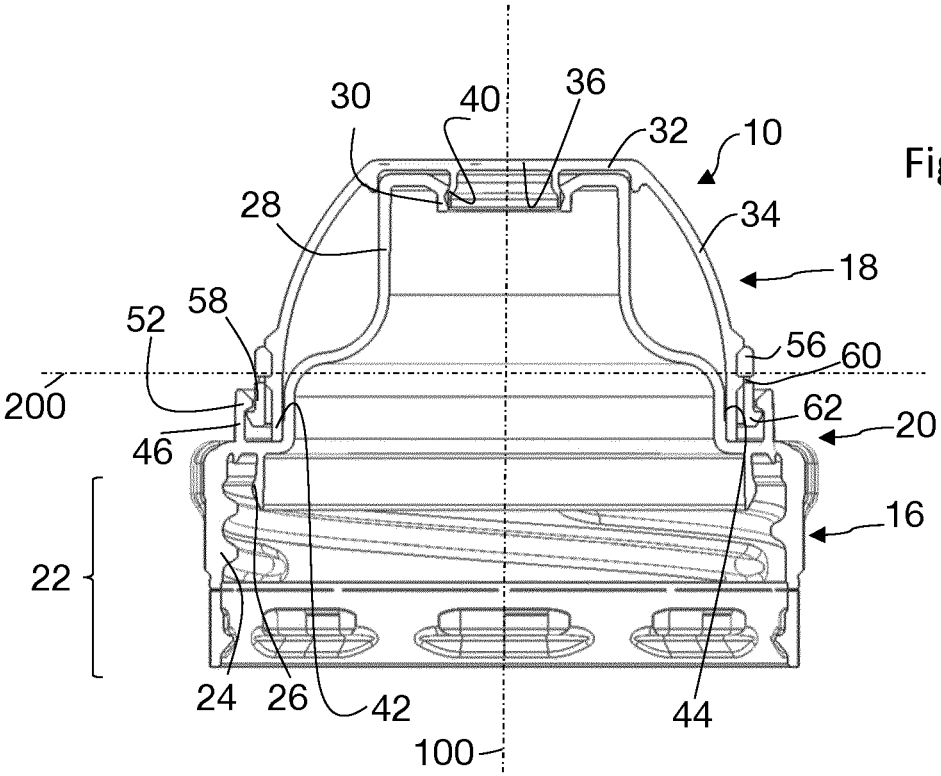
FIG. 2: a sectional view of the container closure in accordance with the first embodiment in the closed position in front of the first opening, through a second longitudinal sectional plane extending transversely to the sectional plane of FIG. 1.

The container closure 10 is produced as follows. The closure piece 12 is produced by an injection molding method in the open position of FIGS. 3 and 4, and in a first assembly step is placed in the closed position of FIG. 6. In a second assembly step, the tamper-evident ring 14 is placed on the cap portion 18 by elastic deformation until the annular bead 56 penetrates the annular groove 54 and makes a form-fit connection with the cap portion 18 while the indicator portion 58 partially penetrates the cavity 48 and the hook portion 62 engages behind the shoulder 52 of the peripheral wall 46 of the base portion 16, as shown in FIGS. 1 and 2. The mean interruption 63 of the indicator portion 58 matches the mean interruption 53 of the shoulder 52 to precisely index the position of the indicator portion in the circumferential direction. In accordance with one variation, the interruptions 53, 63 may be omitted, if necessary.

The indicator portion 58 is partially located in an upper area of the cavity 48, radial between the peripheral wall 46 and the lower edge area 42 of the cap portion 18, and circumferentially between the stops 50, and projects axially out of the cavity 48 so as to remain partially radially visible in front of the first opening. The hinge 20 and the indicator portion 58 are on the same side of a transverse plane 200 that extends through the annular bead 56.

When the container closure 10 is first moved from the closed position of FIGS. 1 and 2 to the open position of FIGS. 7, the indicator portion 58 is held by the shoulder 52 and the bead 56 is held by the groove 54. The breaking zone 60 breaks while the bead 56 remains in the groove 54 and the indicator portion 58 falls into the lower area of the cavity 48 due to gravity.

When the container closure 10 is returned to the closed position of FIG. 8 after the first opening, the indicator portion 58 remains in the lower area of the cavity 48, where it is entirely covered by the peripheral wall 46 of the base portion 16. This ensures a non-reversible and visible change of the container closure 10. The indicator portion 58 remains trapped in the cavity 48.

Figure 9:
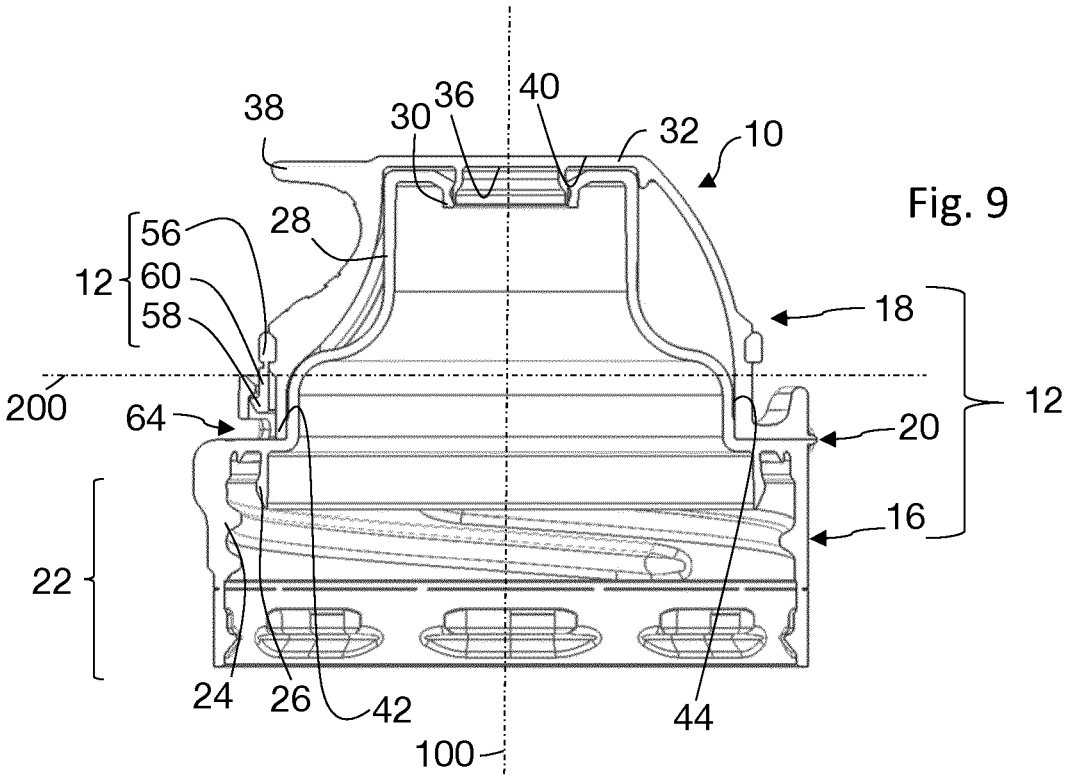
FIG. 9: a sectional view of a container closure in accordance with a second embodiment of the invention in a closed position in front of the first opening.
Figure 10:
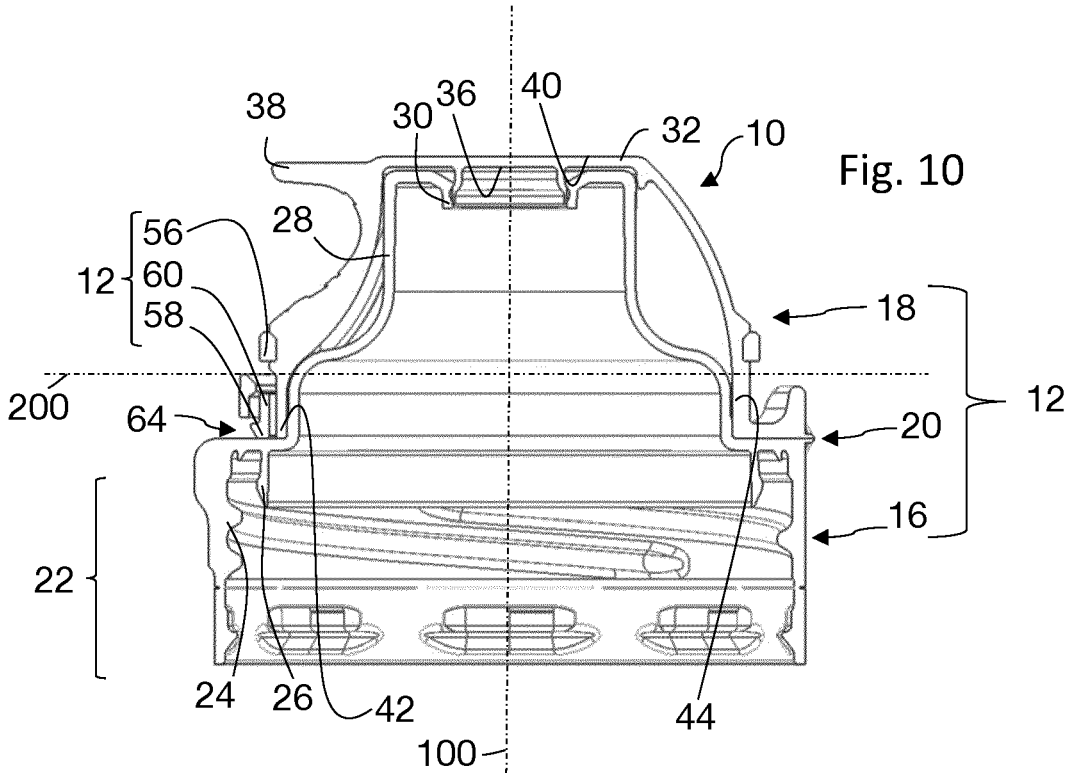
FIG. 10: A sectional view of a container closure in accordance with the second embodiment of the invention in a closed position after the first opening.

The container closure 10 in accordance with the second embodiment is illustrated in FIGS. 9 and 10, and differs from the first example only in that the peripheral wall 46 of the base portion 16, which delimits the cavity 48 radially outwardly, has in the lower area a window 64 through which the indicator portion 58, after having fallen into the lower area of the cavity 48 after the first opening, becomes visible. In this example of embodiment, the hook portion 62 of the indicator portion 58 has no interruption and engages behind a shoulder 52 of the peripheral wall 46, which also has no middle interruption.

Figure 11:
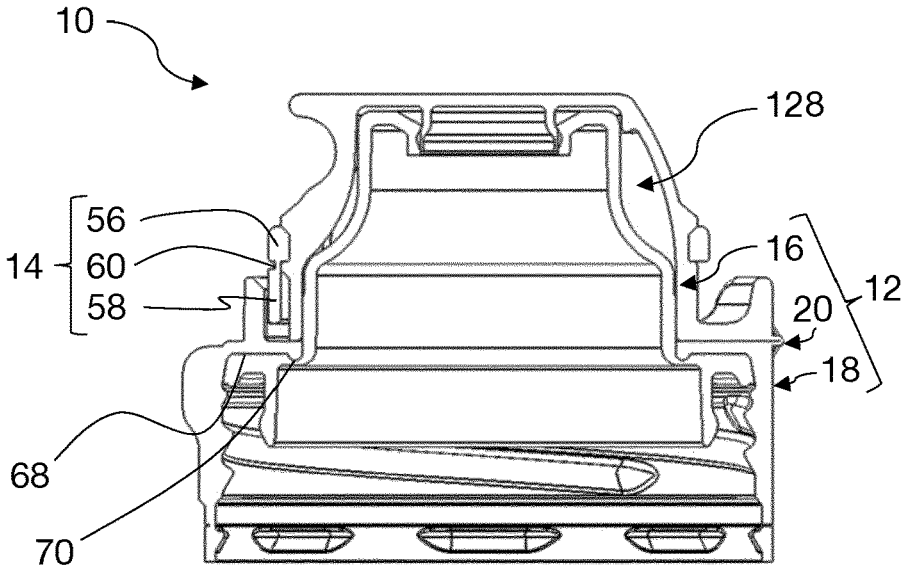
FIG. 11: a sectional view of a container closure in accordance with a third embodiment of the invention in a closed position in front of the first opening.
Figure 12:
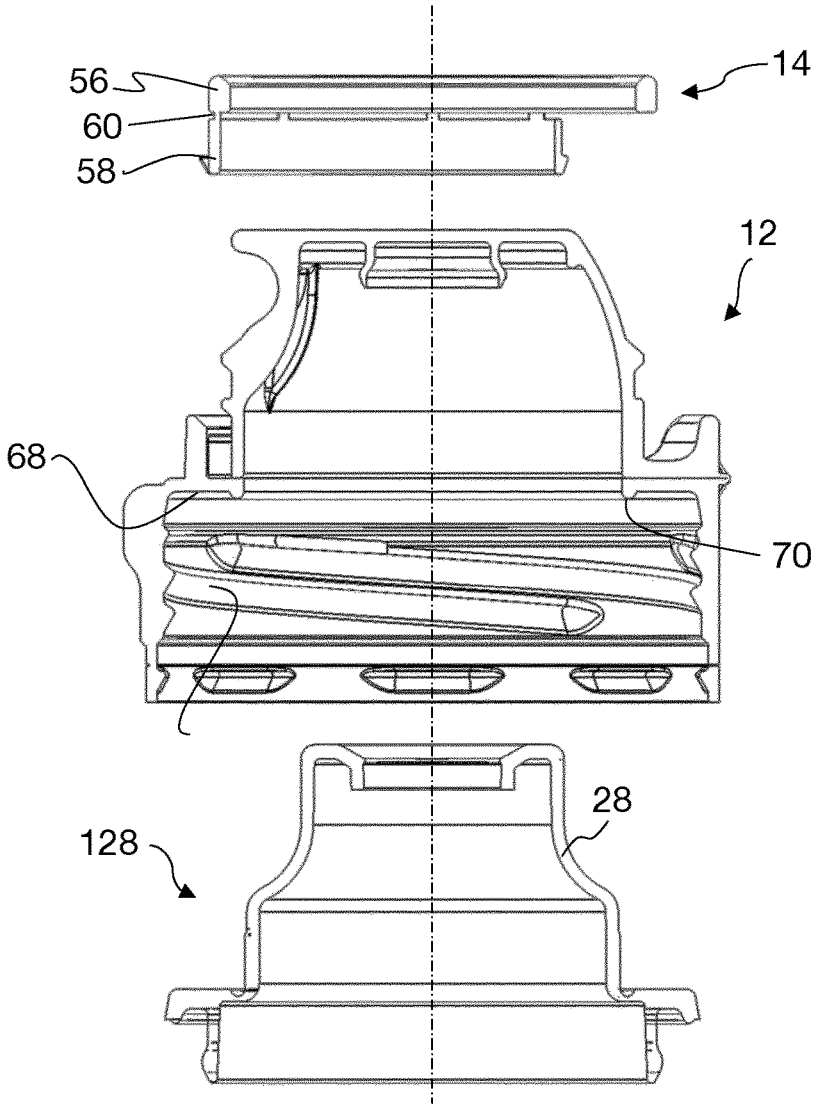
FIG. 12: a sectional view of the individual injection molded parts forming the container closure in accordance with the third embodiment together of FIG. 4, before they are assembled.
Figure 13:
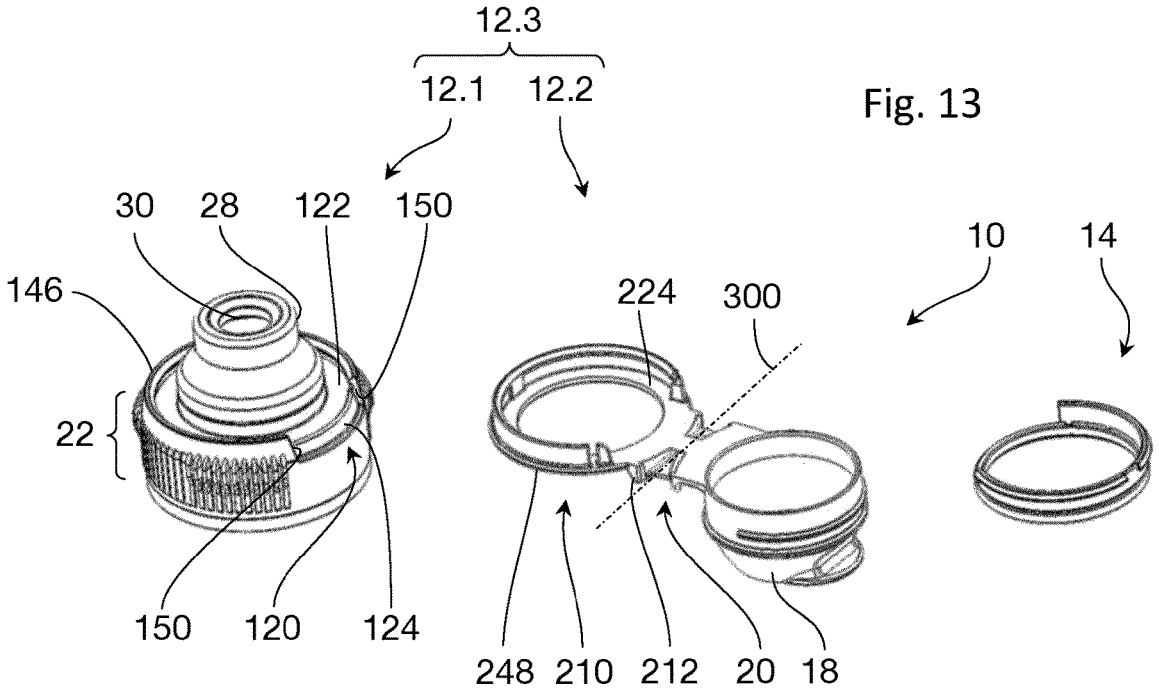
FIG. 13: a perspective view of the three parts of a container closure in accordance with a fourth embodiment of the invention.
Figure 14:
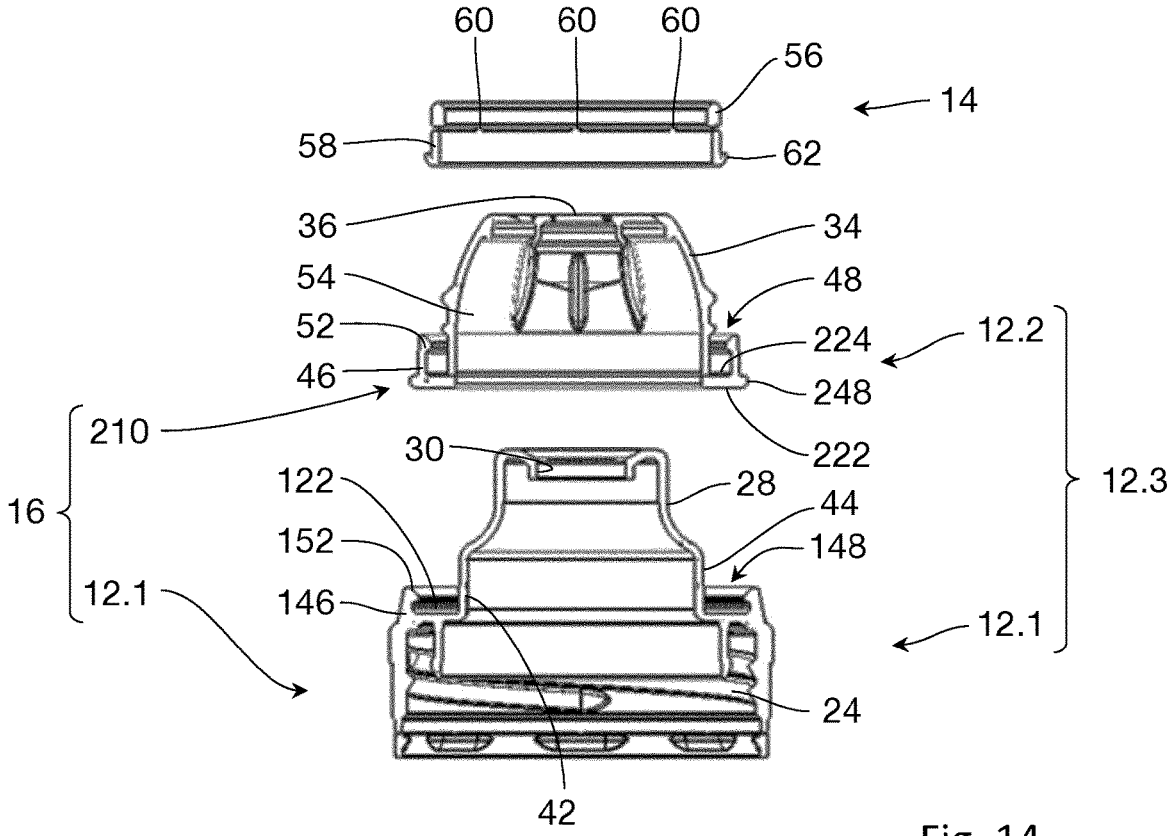
FIG. 14, a sectional view of the three parts of a container closure in accordance with the fourth embodiment of the invention.

The container closure 10 in accordance with the third embodiment is shown in FIGS. 11 and 12, and differs from the first embodiment in that the container closure 10 has a spout 128 separate from the closure piece 12, which is mounted inside the attachment area 22 of the base portion 16 and abuts against a shoulder 68 of the attachment portion, which has a sealing bead 70. This spout 128 forms the spout area 28 of the container closure. The mounting of the spout 128 can take place before, after or simultaneously with the mounting of the tamper-evident ring 14.

The container closure 10 in accordance with the fourth embodiment is shown in FIGS. 13 to 18, and comprises three separate pieces, namely a base piece 12.1, a head piece 12.2 and a tamper-evident ring 14, wherein the base piece 12.1 and the head piece 12.2 in the assembled state in FIGS. 15 to 18 form an assembly 12.3 which is substantially identical in form and function to the closure piece 12 of the first embodiment.

The base piece 12.1 comprises a connecting portion 22 having a thread 24 for connection to a container neck, a pouring portion 28 forming the drinking opening 30 of the container closure 10, and a curved peripheral wall 146 which projects axially from a flat upper bearing surface 122 of the attachment area 22 in the direction opposite to the thread 24 and extends over an angle preferably greater than 180°, in the example greater than 270° about the reference axis 100 of the container closure 10. The two circumferentially opposite ends of the peripheral wall 146 form two lateral stops 150, which circumferentially delimit a recess 120 of the base piece. The peripheral wall 146 has a radially inwardly projecting shoulder 152 and bounds a groove 148 with the upper bearing surface 122 of the attachment area 22.

The head piece 12.2 has a cap portion 18, a hinge 20, and an anchor ring 210 connected at a lower extension 212 of the hinge.

The anchor ring 210 comprises an annular flat lower bearing surface 222, an annular flat upper bearing surface 224 and an arcuate anchor protrusion 248, the dimensions of which correspond to the dimensions of the bearing surface 122, resp. of the peripheral wall 146 and its shoulder 152, so that after mounting the anchor projection 248 behind the shoulder 152 engages form- or frictionally engages while the bearing surface 222 rests on the bearing surface 122 over a wide area, in such a way that there is no possibility of movement between the anchor ring 210 and the base piece 12.1, and that the anchor ring 210 and the base portion 12.1 together form a base portion 16 having the same outer shape as the base portion 16 of the first embodiment.

Figure 16:
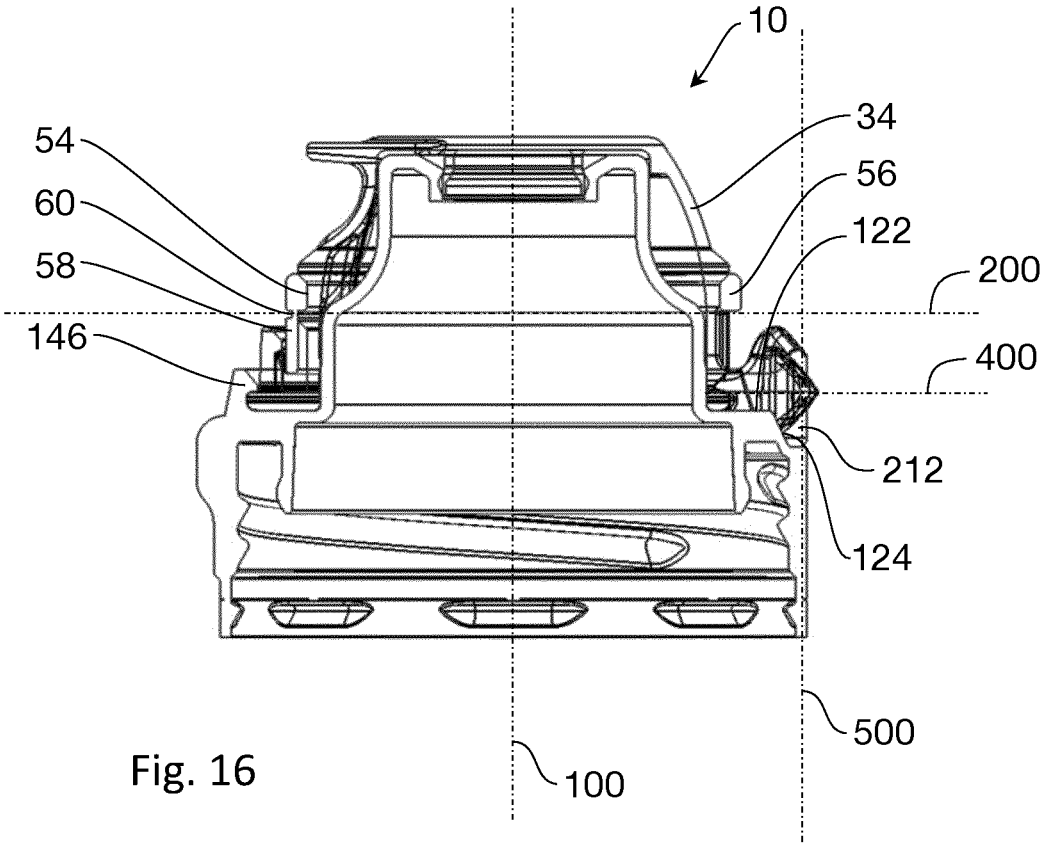
FIG. 16: a sectional view of the container closure in accordance with the fourth embodiment in the closed position in front of the first opening, through a second longitudinal sectional plane extending transversely to the sectional plane of FIG. 15.
Figure 17:
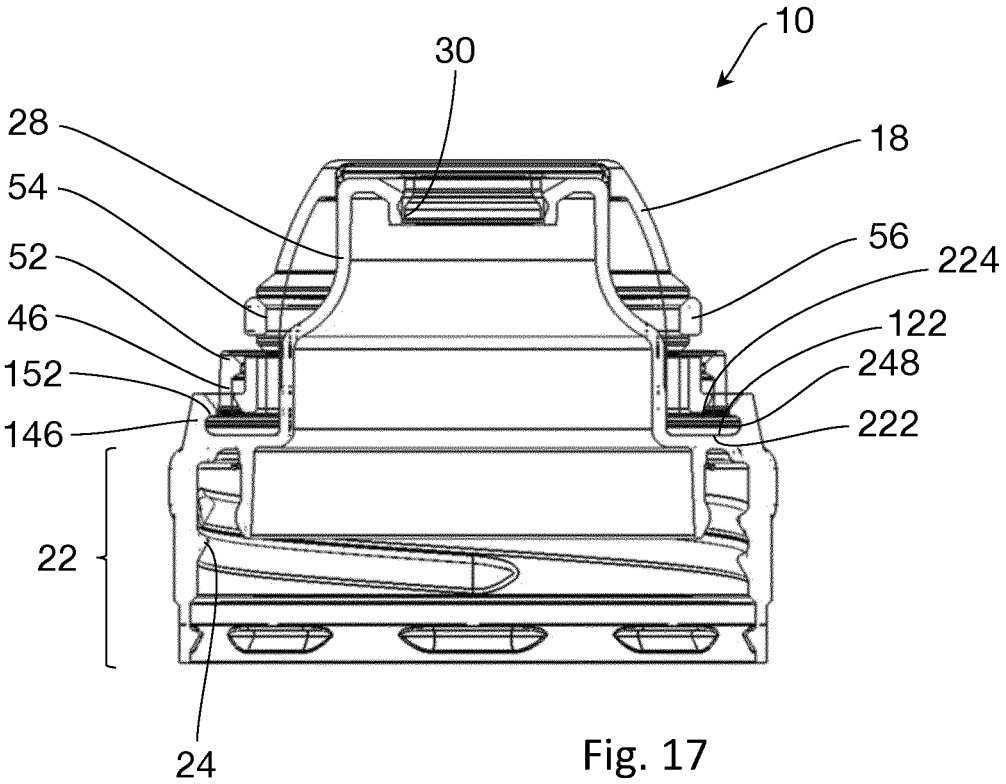
FIG. 17: a sectional view of the container closure in accordance with the fourth embodiment, in the closed position after the first opening.
Figure 18:
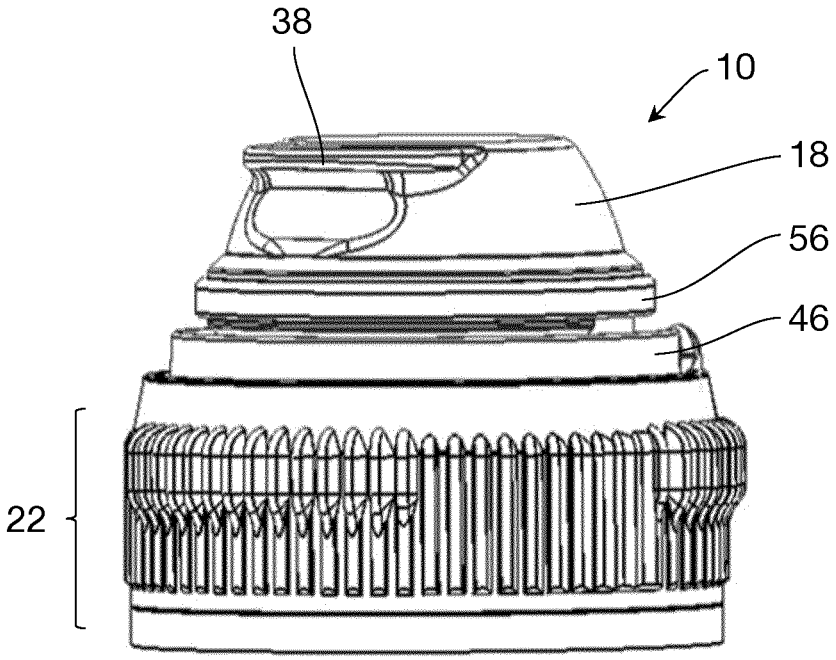
FIG. 18: a perspective view of the container closure in accordance with the fourth embodiment, in the closed position after the first opening.

The hinge 20 is shown here as a snap hinge and allows the cap portion 18 to pivot about a pivot axis 300 that extends perpendicular to the section plane of FIG. 16. The offset 212 of the hinge 20 rests in the recess 120 on the bearing surface 122 and radially on a bearing surface 124 of the recess 120 and is held circumferentially against the lateral stops 150. The pivot axis 300 is the line of intersection between a transverse plane 400 extending between the bearing surface 122 and the annular groove 54 of the cap portion 18 in the closed position and an orthoradial plane 500 which extends parallel to the reference axis 100 of the base portion 16 and is further from the reference axis 100 than the outer surface of the peripheral wall 146.

After mounting, the head piece 12.2 and the base piece 12.1 together form an assembly 12.3 having the same external shape and the same function as the closure piece 12 of the first embodiment, with the exception that the two pieces 12.1, 12.2 may be made of two different materials, or have different colors. For example, it is possible to produce the head piece 12.2 from transparent or opaque polypropylene (PP) and the base piece 12.1 from high density polyethylene (HDPE).

The anchor ring 210 has a curved peripheral wall 46 that extends through an angle preferably greater than 180°, in the example greater than 270° about the reference axis 100 of the container closure 10. The peripheral wall 46 has a radially inwardly projecting shoulder 52, which has the same shape and function as the shoulder 52 of the first embodiment and, after mounting, is radially opposite the lower edge area 42 of the outer wall 34 of the cap portion 18 and defines a cavity 48 with the latter and the upper bearing surface 224.

The tamper-evident ring 14 is identical to that of the first embodiment, to which reference is made for a detailed description.

Figure 15:
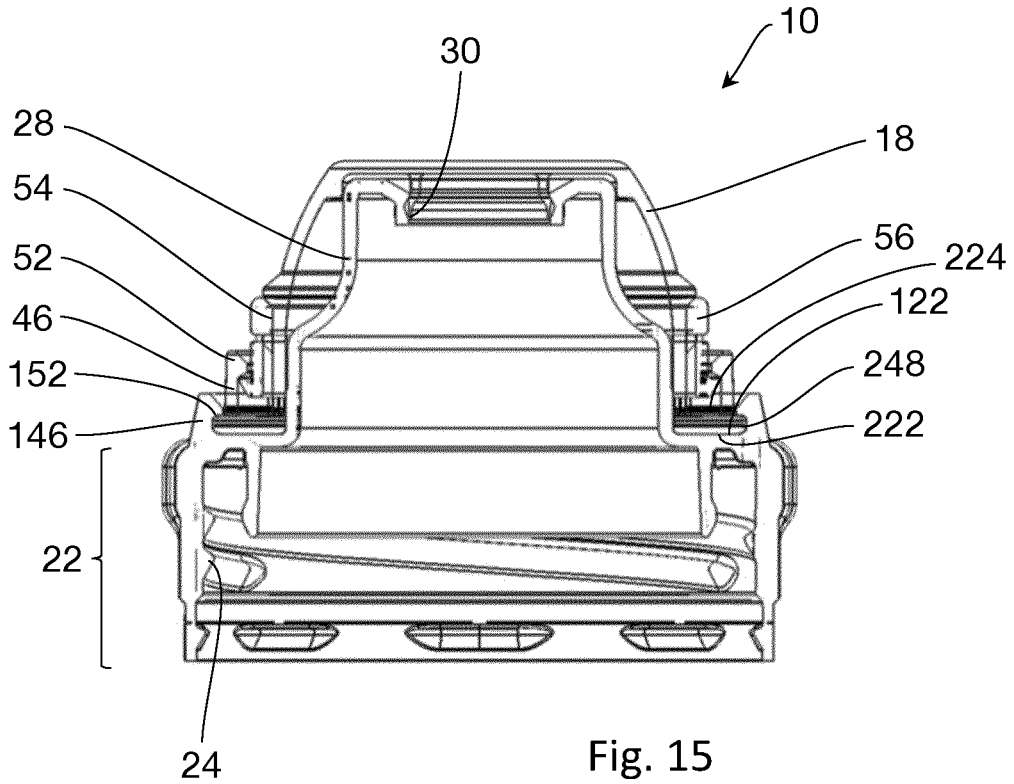
FIG. 15, a sectional view of the container closure in accordance with the fourth embodiment of the invention in a closed position in front of the first opening.

The container closure 10 is produced as follows. The three pieces 12.1, 12.2, 14 are produced separately by injection molding, with the head piece 12.2 in the open position of FIG. 13. In a first assembly step, the cap portion 18 is brought into the closed position. Then the collapsed head piece 12.2 is placed on the base piece 12.1 until the anchor protrusion 248 of the anchor ring 210 is seated behind the shoulder 52. In a third assembly step, the tamper-evident ring 14 is placed on the cap portion 18 by elastic deformation until the annular bead 56 penetrates the annular groove 54 and makes a form-fit connection with the cap portion 18 while the indicator portion 58 partially penetrates the cavity 48 and the hook portion 62 engages behind the shoulder 52 of the peripheral wall 46 of the anchor ring 16, as shown in FIGS. 15 and 16.

If necessary, the sequence of the three assembly steps can be changed. For example, the cap portion 18 can be placed in the closed position after the open head piece 12.2 is placed on the base piece 12.1. The tamper-evident ring 14 can be placed on the open head piece 12.2 if necessary.

After mounting, the indicator portion 58 is partially located in an upper area of the cavity 48, radially between the peripheral wall 46 and the lower edge area 42 of the cap portion 18, and partially out of the cavity 48 so that it remains partially radially visible in front of the first opening. When the container closure 10 is first moved from the closed position of FIGS. 15 and 16 to the open position, the indicator portion 58 is held by the shoulder 52 and the bead 56 is held by the groove 54. The breaking zone 60 breaks while the bead 56 remains in the groove 54 and the indicator portion 58 falls into the lower area of the cavity 48 due to gravity. When the container closure 10 is returned to the closed position of FIGS. 17 and 18 after the first opening, the indicator portion 58 remains in the lower area of the cavity 48 on the upper bearing surface 224 of the anchor ring 210, where it is entirely covered by the peripheral wall 46 of the base portion 16. This ensures a non-reversible and visible change of the container closure 10. The indicator portion 58 remains trapped in the cavity 48.

Figure 19:
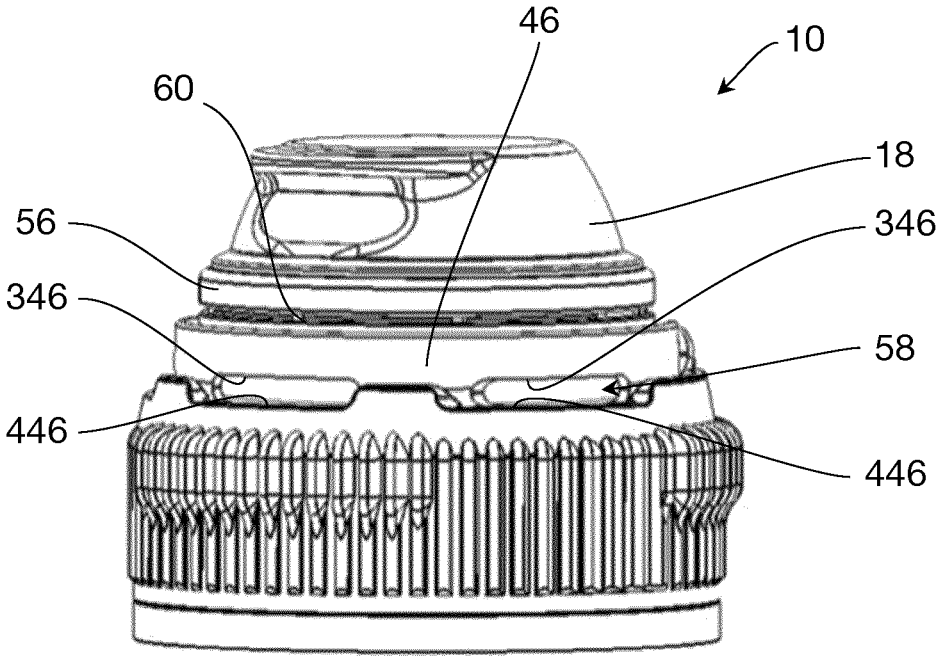
FIG. 19: a sectional view of a container closure in accordance with a fifth embodiment, in a closed position forward of the first opening.
Figure 20:
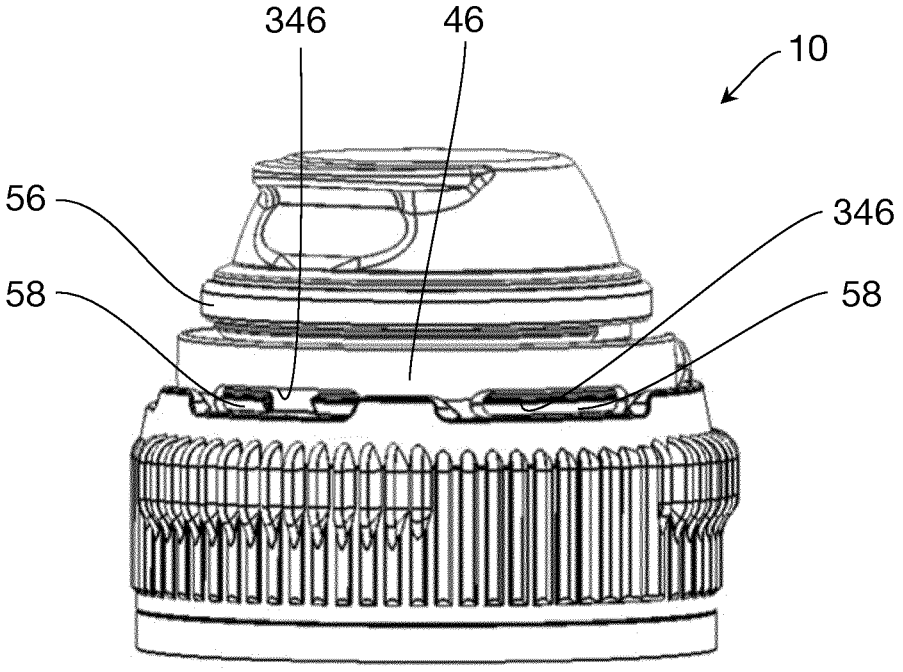
FIG. 20: a perspective view of the container closure in accordance with the fifth embodiment, in the closed position after the first opening.

The embodiment example of FIGS. 19 and 20 differs from the embodiment example of FIGS. 13 to 18 only in that the peripheral wall of the anchor ring 210 has recesses or windows 346 which, if necessary, correspond to recesses 446 of the peripheral wall 146 of the base piece 12.1 and through which, before the separation of the breaking zone 60 (on FIG. 19), the cavity 58 and, after the separation of the breaking zone 60 (on FIG. 20), the indicator portion 58 become visible.

Other variants are intended. The outer tamper-evident ring 12 according to the invention can be applied to a container closure having a closure piece 12 and a spout 128, wherein the closure piece 12 has a base portion 16 and a cap portion 18 which are injected in the closed position, and the spout 128 is inserted into the closed closure piece 12. It can also be used with a container closure without a hinge, particularly a so-called push-pull container closure.

The invention claimed is:

1. A container closure comprising a base portion extending about a reference axis of the container closure, a cap portion which in a closed position covers a drinking opening of the container closure and in an open position leaves the drinking opening of the container closure open and a tamper-evident ring made of an element inde-pednent from the cap portion and base portion, the tamper-evident ring being positively connected to the cap portion and hooked to the base portion and having a breaking zone which breaks when the cap portion is opened and causes a non-reversible and visible change in the container closure, wherein the tamper-evident ring, for form-fit connection with the cap portion, has an annular bead which is not radially covered by the base portion and extends into an annular groove of an outermost wall of the cap portion which points radially outwards.

2. The container closure according to claim 1, wherein the tam-per-evident ring has an indicator portion for hooking to the base portion and engaging behind a shoulder of the base portion, wherein the breaking zone is between the bead and the indicator portion.

3. The container closure according to claim 2, wherein the base portion has a peripheral wall enclosing the indicator portion and a cavity of the base portion, wherein the indicator portion is capable of falling into a lower area of the cavity due to gravity upon opening of the cap portion and rupture of the breaking zone.

4. The container closure according to claim 3, wherein the peripheral wall has a radially outwardly directed window configured to allow the indicator portion to be visible in the lower part of the cavity through the window only after the breaking zone has ruptured.

5. The container closure according to claim 2, wherein the indicator portion projects radially outwardly and the shoulder projects radially inwardly.

6. The container closure according to claim 1, wherein the base portion is connected to the cap portion by a hinge.

7. The container closure according to claim 6, wherein the cap portion is integrally designed with the hinge and the base portion.

8. The Container closure according to claim 6, wherein the base portion has a base piece and an anchor ring that engages in an annular groove of the base piece, the anchor ring being integral with the hinge and the cap portion.

9. The container closure according to claim 8, wherein the breaking zone is axially located between the annular bead and the anchor ring.

10. The container closure according to claim 9, wherein the tam-per-evident ring has an indicator portion for hooking to the base portion and engaging behind a shoulder of the base portion, wherein the indicator portion is axially located between the breaking zone and the anchor ring.

11. The container closure according to claim 10, wherein the base portion comprises a cavity, and wherein the cavity is axially located between the indicator portion and the anchor ring.

12. The container closure according to claim 6, wherein a hook-like connection between the tamper-evident ring and the base portion and the hinge is located on the same side of a transverse plane extending through the annular bead.

13. The container closure according to claim 1, wherein the base portion has a connection portion, particularly a thread, for connection to a container neck.

14. The container closure according to claim 1, wherein the base portion has a preferably radially outwardly directed sealing bead.

15. The container closure according to claim 1, wherein the base portion has a pouring portion forming the drinking opening of the container closure.

16. The container closure according to claim 1, further comprising a spout separate from the base portion and forming the drinking opening of the container closure.

17. The container closure according to claim 1, wherein the cap portion has a bottom and an outermost wall of the bottom tapers from the groove to the bottom.

18. The container closure according to claim 1, wherein the cap portion is produced from an opaque material.

19. A method for assembling a container closure, the container closure according to claim 1, wherein the tamper-evident ring is placed on the cap portion in the closed position by elastic deformation until the annular bead penetrates the annular groove and the tamper-evident ring becomes hooked to the base portion.

* * * * *